US009435201B2

(12) United States Patent
Paterson

(10) Patent No.: US 9,435,201 B2
(45) **Date of Patent: *Sep. 6, 2016**

(54) DETECTING SUMP DEPTH OF A MINER

(71) Applicant: Joy MM Delaware, Inc., Wilmington, DE (US)

(72) Inventor: Alastair J. Paterson, Wollongong (AU)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/970,508

(22) Filed: Dec. 15, 2015

(65) Prior Publication Data

US 2016/0102551 A1 Apr. 14, 2016

Related U.S. Application Data

(63) Continuation of application No. 14/473,376, filed on Aug. 29, 2014, now Pat. No. 9,222,355.

(60) Provisional application No. 61/871,576, filed on Aug. 29, 2013, provisional application No. 61/871,581, filed on Aug. 29, 2013, provisional application No. 61/871,583, filed on Aug. 29, 2013, provisional application No. 61/871,586, filed on Aug. 29, 2013.

(51) Int. Cl.
*E21C 35/08* (2006.01)
*E21C 35/24* (2006.01)
(Continued)

(52) U.S. Cl.
CPC ..... *E21C 35/24* (2013.01); *E21C 25/06* (2013.01); *E21C 35/08* (2013.01); *E21C 35/12* (2013.01); *E21C 41/16* (2013.01); *E21F 17/18* (2013.01)

(58) Field of Classification Search
CPC ..... E21C 35/06; E21C 35/08; E21C 35/24
USPC ..... 299/1.4
See application file for complete search history.

(56) References Cited

U.S. PATENT DOCUMENTS 3,371,964 A 3/1968 Weber
3,603,686 A 9/1971 Paine et al.
(Continued)

FOREIGN PATENT DOCUMENTS

DE 3119180 A1 12/1982
DE 3121684 A1 12/1982
(Continued)

OTHER PUBLICATIONS

Offce Action from the United States Patent and Trademark Office for U.S. Appl. No. 14/472,826 dated Apr. 27, 2015 (24 pages).
(Continued)

*Primary Examiner* — John Kreck
*Assistant Examiner* — Michael Goodwin
(74) *Attorney, Agent, or Firm* — Michael Best & Friedrich LLP

(57) ABSTRACT

Systems and methods for operating a mining machine. One system includes a controller, a stationary object, and a radar device. The radar device transmits radio waves toward the stationary object and detects reflections of the radio waves. The controller obtains timing information regarding the radio waves and the reflections. Based on the timing information, the controller is configured to determine a first distance between the radar device and the stationary object before sumping the mining machine into material and a second distance between the radar device and the stationary object after sumping the mining machine into the material. The controller is also configured to determine a sump depth of the mining machine based on the first distance and the second distance, compare the determined sump depth to a predetermined sump depth, and perform at least one automatic action when the determined sump depth does not satisfy the predetermined sump depth.

20 Claims, 11 Drawing Sheets

(51) Int. Cl.

| | |
|---|---|
| ***E21F 17/18*** | (2006.01) |
| ***E21C 25/06*** | (2006.01) |
| ***E21C 41/16*** | (2006.01) |
| ***E21C 35/12*** | (2006.01) |

(56) References Cited

U.S. PATENT DOCUMENTS

| | | | |
|---|---|---|---|
| 3,719,394 | A | 3/1973 | Hartley |
| 4,072,945 | A | 2/1978 | Katsumata et al. |
| 4,104,634 | A | 8/1978 | Gillard et al. |
| 4,261,617 | A | 4/1981 | Droescher et al. |
| 4,351,565 | A | 9/1982 | Takahashi et al. |
| 4,407,388 | A | 10/1983 | Steel |
| 4,465,155 | A | 8/1984 | Collins |
| 4,531,782 | A | 7/1985 | Ford et al. |
| 4,790,402 | A | 12/1988 | Field et al. |
| 4,884,847 | A | 12/1989 | Bessinger et al. |
| 4,920,520 | A | 4/1990 | Goebel et al. |
| 4,953,915 | A | 9/1990 | Jasser et al. |
| 4,981,327 | A | 1/1991 | Bessinger et al. |
| 5,170,352 | A | 12/1992 | McTamaney et al. |
| 5,247,306 | A | 9/1993 | Hardange et al. |
| 5,500,649 | A | 3/1996 | Mowrey et al. |
| 5,607,205 | A | 3/1997 | Burdick et al. |
| 5,631,658 | A | 5/1997 | Gudat et al. |
| 5,667,279 | A | 9/1997 | Christopher et al. |
| 5,670,962 | A | 9/1997 | Henderson et al. |
| 5,769,503 | A | 6/1998 | Stolarczyk et al. |
| 5,995,037 | A | 11/1999 | Matsuda et al. |
| 5,999,865 | A | 12/1999 | Bloomquist et al. |
| 6,062,650 | A | 5/2000 | Smith et al. |
| 6,064,926 | A | 5/2000 | Sarangapani et al. |
| 6,666,521 | B1 | 12/2003 | Pease et al. |
| 6,791,488 | B2 | 9/2004 | Diekhans et al. |
| 7,076,346 | B2 | 7/2006 | Sturges et al. |
| 9,222,355 | B2 | 12/2015 | Paterson |
| 2002/0030398 | A1 | 3/2002 | Drake et al. |
| 2002/0030400 | A1 | 3/2002 | Frederick et al. |
| 2003/0004644 | A1 | 1/2003 | Farmer |
| 2003/0083818 | A1 | 5/2003 | Tojima |
| 2003/0151541 | A1 | 8/2003 | Oswald et al. |
| 2004/0217851 | A1 | 11/2004 | Reinhart |
| 2005/0088335 | A1 | 4/2005 | Stephens |
| 2006/0022870 | A1 | 2/2006 | Zimmerman et al. |
| 2007/0216216 | A1 | 9/2007 | Baird, Jr. et al. |
| 2008/0185903 | A1 | 8/2008 | Bausov et al. |
| 2008/0218400 | A1 | 9/2008 | Stolarczyk et al. |
| 2009/0088979 | A1 | 4/2009 | Koch |
| 2009/0134692 | A1 | 5/2009 | Hargrave et al. |
| 2009/0259399 | A1 | 10/2009 | Kotejoshyer et al. |
| 2009/0259400 | A1 | 10/2009 | Coats et al. |
| 2009/0259401 | A1 | 10/2009 | Edwards et al. |
| 2009/0326734 | A1 | 12/2009 | Gudat |
| 2010/0194175 | A1 | 8/2010 | Hackelboerger et al. |
| 2010/0223008 | A1 | 9/2010 | Dunbabin et al. |
| 2010/0320827 | A1 | 12/2010 | Junker |
| 2010/0327650 | A1 | 12/2010 | Junker et al. |
| 2011/0074619 | A1 | 3/2011 | Martinez Godoy et al. |
| 2011/0249118 | A1 | 10/2011 | Bruno |
| 2012/0038205 | A1 | 2/2012 | Mundry et al. |
| 2012/0098325 | A1 | 4/2012 | Junker et al. |
| 2012/0161493 | A1 | 6/2012 | Junker et al. |
| 2012/0212365 | A1 | 8/2012 | Feil |

FOREIGN PATENT DOCUMENTS

| | | | |
|---|---|---|---|
| DE | 3347389 | A1 | 2/1986 |
| DE | 19752686 | A1 | 6/1999 |
| EP | 2242901 | A1 | 10/2010 |
| GB | 1481917 | A | 8/1977 |
| GB | 2044032 | A | 10/1980 |
| GB | 2077831 | A | 12/1981 |
| JP | 2003531980 | A | 10/2003 |
| WO | 03058031 | A1 | 7/2003 |
| WO | 2009052938 | A2 | 4/2009 |
| WO | 2011113581 | A1 | 9/2011 |

OTHER PUBLICATIONS

Search Report of the International Searching Authority for Application No. PCT/US2014/053493 dated Dec. 16, 2014 (5 pages).

Written Opinion of the International Searching Authority for Application No. PCT/US2014/053493 dated Dec. 16, 2014 (5 pages).

Search Report and Written Opinion of the International Searching Authority for Application No. PCT/US2014/053484 lated Dec. 9, 2014 (14 pages).

Ralston, J.C. et al., "Recent advances in remote coal mining machine sensing, guidance, and teleoperation," Robotica 1 (2001), vol. 19, pp. 513-526, Cambridge University Press, CSIRO Exploration and Mining, PO Box 883, Kenmore Q D4069 (Australia).

Baker, C. et al., "A Campaign in Autonomous Mine Mapping," Proceedings of the 2004 IEEE International Conference on Robotics & Automation, Apr. 2004, New Orleans, Louisiana, pp. 2004-2009.

Nienhaus, K. et al., "Wireless sensing applications in the mining and minerals industry," Proceedings of the 2009 IEEE MTI-S International Microwave Workshop on Wireless Sensing, Local Positioning, and RFID (IMWS), 2009, 4 pages.

Schmitz, R. et al., "Conveyor belt muck built-up detection and messaging system," Transactions of the Institutions of Mining and Metallurgy, Section A: Mining Technology, vol. 117, No. 3, pp. 111-115, Sep. 2008.

Ruff TM, "Test Results of Collision Warning Systems for Surface Mining Dump Trucks," NIOSH-2000-120, May 2000, 52 pages.

Khrebtov, P., "A Wireless Location System for Sensing the Relative Position between Mining Vehicles," Instrumentation and Measurement Technology Conference Proceedings, 2007.

Ruff TM, "Recommendations for Evaluating and Implementing Proximity Warning Systems on Surface Mining Equipment," available at http://stacks.cdc.gov/view/cdc/8494, published Jun. 1, 2007.

European Commission European Research Area. "New mechanisation and automation of longwall and drivage equipment (NEMAEQ)," European Union, 2011, 138 pages.

International Longwall News, Eickoff Automation article, Dec. 7, 2010, 2 pages.

Eickhoff SL 750 EiControlPlus Shearer Loader Press Release, Dec. 15, 2009, 4 pages.

DETECTING SUMP DEPTH OF A MINER

RELATED APPLICATIONS

This application is a continuation of U.S. application Ser. No. 14/473,376 filed Aug. 29, 2014, which claims priority to U.S. Provisional Application Nos. 61/871,576, 61/871,581, 61/871,583, and 61/871,586, each filed Aug. 29, 2013. The entire content of each priority application is hereby incorporated by reference.

BACKGROUND

Embodiments of the invention relate to methods and systems for detecting a position of mining equipment, such as a continuous miner.

SUMMARY

After performing a shear or a pass, mining equipment, such as a continuous miner, is advanced or "sumped" into the cutting face before performing the next shear or pass. The "sump depth" of a continuous miner is the distance the continuous miner trams forward into material before shearing up or down. There is a predetermined desired (e.g., optimum) "sump depth," which can be related to the diameter of the cutting drum, the hardness of the material being cut, and the power or energy available for cutting. "Sumping" too far into the material puts excessive load on the cutter motors and can create an improper (e.g., unsafe) roof and/or floor profile. Similarly, not "sumping" enough into the material results in inefficient production. Measuring "sump depth," however, can be difficult given the dust and spray present during cutting and the fact that tracks and tires can slip on wet muddy floors.

Accordingly, embodiments of the invention provide systems and methods for detecting a sump depth of a continuous miner. One embodiment of the invention provides a system for detecting sump depth. The system includes a radar device mounted on a continuous miner. The radar device transmits radio waves and detects reflected radio waves. The system also includes at least one controller. The controller is configured to receive a distance between the radar device and a roof support (e.g., a roof bolt) positioned behind the continuous miner over a period of time. The controller uses changes to this detected distance over the period of time to determine the sump depth of the continuous miner. In some embodiments, the controller also automatically modifies operation of the continuous miner based on the determined sump depth (e.g., to increase or decrease sump depth). A corner cube reflector can also be attached to the roof bolt to increase accuracy of the radar detection.

Another embodiment of the invention provides a method of detecting a sump depth of a continuous miner. The method includes transmitting a radio wave from a radar device mounted on a rear of a continuous miner (i.e., the end of the miner opposite the end sumping into material) and receiving a reflection of the radio wave from a corner cube reflector positioned on a roof bolt position behind the continuous miner (i.e., behind the rear of the continuous miner). The method also includes using, by a controller, the reflection to determine a sump depth of the continuous miner. In particular, the method includes using the reflection to determine a distance between the radar device and the roof bolt before sumping and a distance between the radar device and the roof bolt during or after sumping. In some embodiments, the method also includes automatically modifying operation of the continuous miner based on the sump depth.

Yet another embodiment of the invention provides a system for operating a mining machine. The system includes at least one controller, a stationary object positioned in a mine, and at least one radar device mounted on the mining machine configured to transmit a plurality of radio waves toward the stationary object and detect a plurality of reflections of the plurality of radio waves. The at least one controller is configured to obtain reflection data from the at least one radar device, the reflection data representing timing information regarding the plurality of radio waves and the plurality of detected reflections. The at least one controller is also configured to determine, based on the reflection data, a first distance between the at least one radar device and the stationary object before sumping the mining machine into material and a second distance between the at least one radar device and the stationary object after sumping the mining machine into the material. In addition, the at least one controller is configured to determine a sump depth of the mining machine based on the first distance and the second distance, compare the determined sump depth to at least one predetermined sump depth, and perform at least one automatic action when the determined sump depth does not satisfy the at least one predetermined sump depth.

The at least one controller is configured to obtain reflection data from the at least one radar device representing timing information regarding the plurality of radio waves and the plurality of detected reflections and use the reflection data to determine a first distance between the at least one radar device and the stationary object before sumping the mining machine into material and a second distance between the at least one radar device and the stationary object after sumping the mining machine into material. The at least one controller is also configured to determine a sump depth of the mining machine based on the first distance and the second distance, compare the determined sump depth to at least one predetermined sump depth, and perform at least one automatic action when the determined sump depth does not satisfy the at least one predetermined sump depth.

Still another embodiment of the invention provides a method of operating a continuous miner. The method includes transmitting a first radio wave from the continuous miner toward a stationary object including a corner cube reflector, receiving a reflection of the first radio wave from the stationary object, and determining, with at least one controller, a first distance between the continuous miner and the stationary object based on the reflection of the first radio wave. The method also includes sumping the continuous miner into material and after sumping the continuous miner into the material, transmitting a second radio wave from the continuous miner toward the stationary object, receiving a reflection of the second radio wave from the stationary object, and determining, with the at least one controller, a second distance between the continuous miner and the stationary object based on the reflection of the second radio wave. The method further includes determining, with the at least one controller, a sump depth of the continuous miner based on a difference between the first distance and the second distance, comparing, with the at least one controller, the determined sump depth to a predetermined sump depth, and, when the determined sump depth does not satisfy the predetermined sump depth, modifying operation of the continuous miner.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, the methods, operations, and sequences described herein can be performed in various orders. Therefore, unless otherwise indicated herein, no required order is to be implied from the order in which elements, steps, or limitations are presented in the detailed description or claims of the present application. Also unless otherwise indicated herein, the method and process steps described herein can be combined into fewer steps or separated into additional steps.

In addition, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. For example, "controllers" described in the specification can include one or more processors, one or more non-transitory computer-readable medium modules, one or more input/output interfaces, and various connections (e.g., a system bus) connecting the components.

Figure 1:
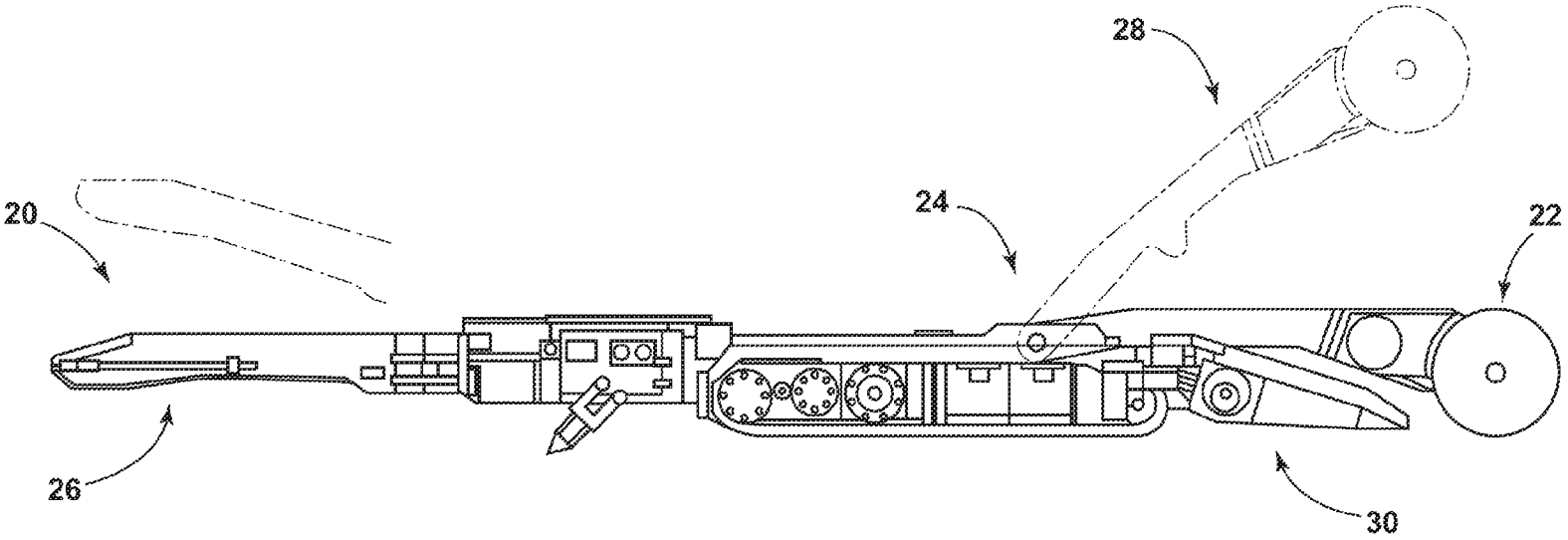
FIG. 1 schematically illustrates mining equipment.

Underground roadway development equipment typically includes a continuous miner and haulage equipment that transports cut material from the cutting face. A continuous miner can include a free-steered, track-mounted, multi-motor mining machine that includes a pick-laced cylindrical cutting drum mounted on a ranging arm and rotating on a horizontal axis. For example, FIG. 1 schematically illustrates a continuous miner 20 according to one embodiment of the invention. The continuous miner includes a cutting drum 22, a chassis or frame 24, and a tail 26. The drum 22 is coupled to a ranging arm 28 that moves the drum 22 from mine roof to floor and/or from mine floor to roof (e.g., as the drum 22 cuts). It should be understood that the frame 24 is typically narrower than the drum 22. Also, the drum 22 may be equal to the width of a roadway being cut or the miner 20 may make more than one pass to create a roadway wider than the drum 22.

The drum 22 is rotated using one or more cutter motors. Material cut by the drum 22 falls in front of the miner 20 (i.e., the end closest to a cutting face) and is gathered by rotating paddles on a gathering head 30. The gathering head 30 pushes collected materials onto a chain conveyor that runs through the body of the miner 20 until it falls off the tail 26 onto haulage equipment. In some embodiments, as illustrated in FIG. 1, the tail 26 can move vertically and/or horizontally to align the tail 26 with the haulage equipment. The haulage equipment can include a shuttle car, a battery hauler, and/or a flexible conveyor train. The haulage equipment transports material cut by the miner 20 to other material handling equipment (e.g., a crusher and/or feeder breaker).

During operation, an operator controls the miner 20 using a remote control. When cutting is performed, the drum 22 rotates clockwise (in the picture of FIG. 1) or "roof to-floor" in terms of engagement of picks or bits included on the drum 22 with material of the cutting face. Water sprays can be used to manage dust generated during cutting by the miner 20.

Figure 2A:
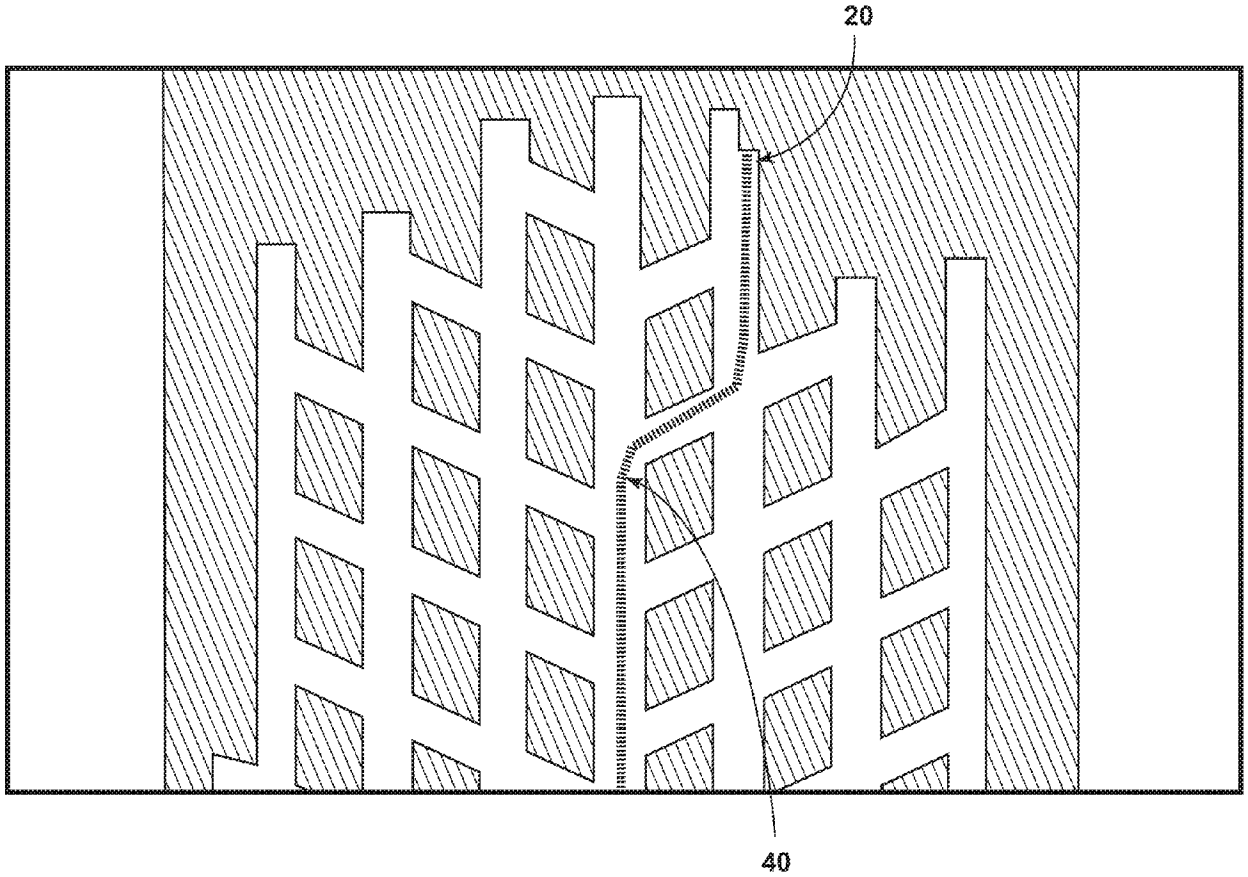
FIGS. 2A-C illustrate roadway development configurations using the mining equipment of FIG. 1.

Roadway development performed using the continuous miner 20 can have a variety of different configurations. For example, the continuous miner 20 can be used to develop a room and pillar roadway as illustrated in FIG. 2A. In this situation, the continuous miner 20 operates in a direction generally toward the top of FIG. 2A and cut material is removed by haulage equipment 40 in the opposite direction. The room and pillar roadway can be used to extract material while leaving roof support.

Figure 2B:
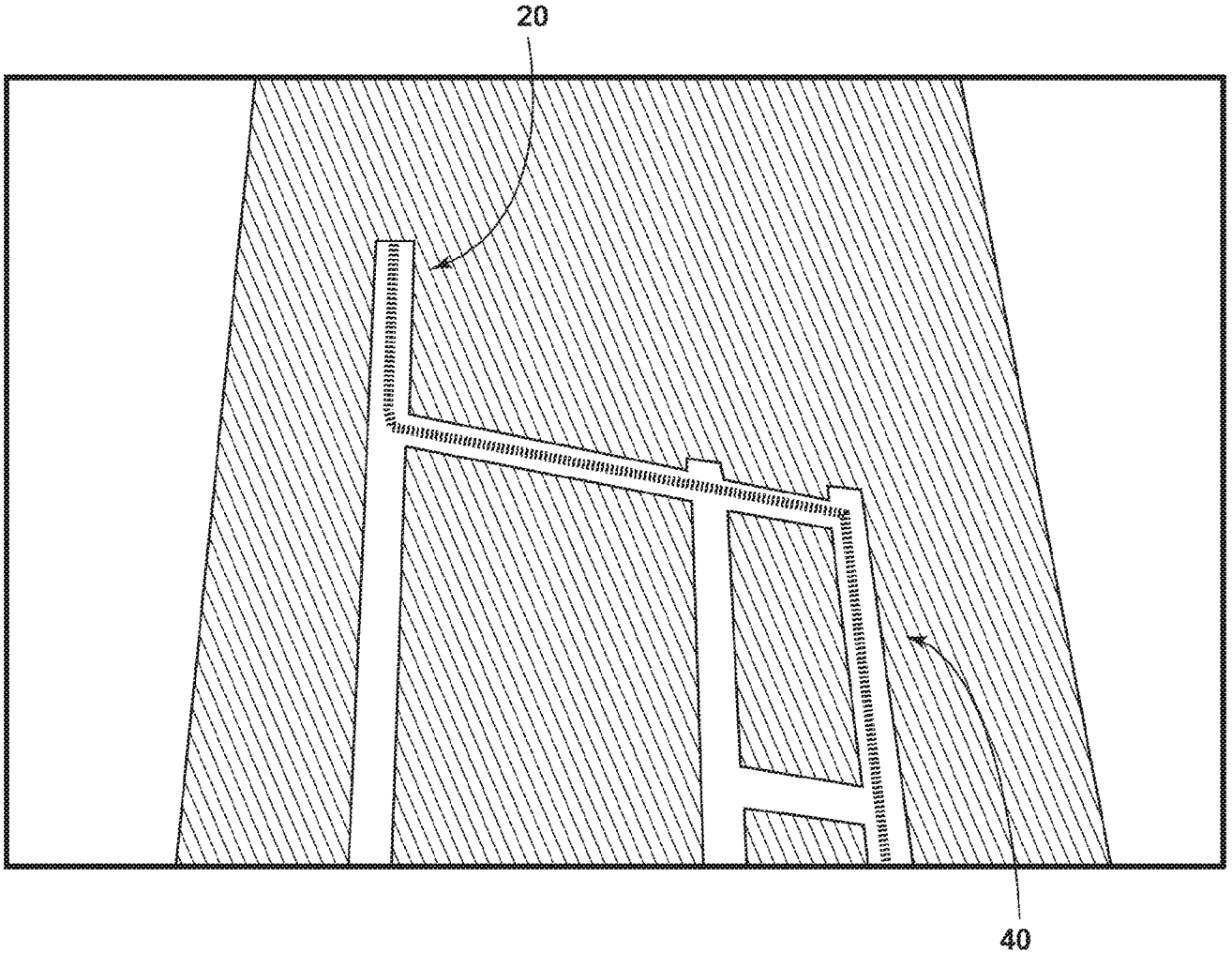

In other embodiments, the continuous miner 20 can be used to develop a longwall gate road as illustrated in FIG. 2B. Again, in this situation, the continuous miner 20 operates in a direction generally toward the top of FIG. 2B and cut material is removed by haulage equipment 40 in an opposite direction. The longwall gate road can be used to set up a longwall mining environment.

Figure 2C:
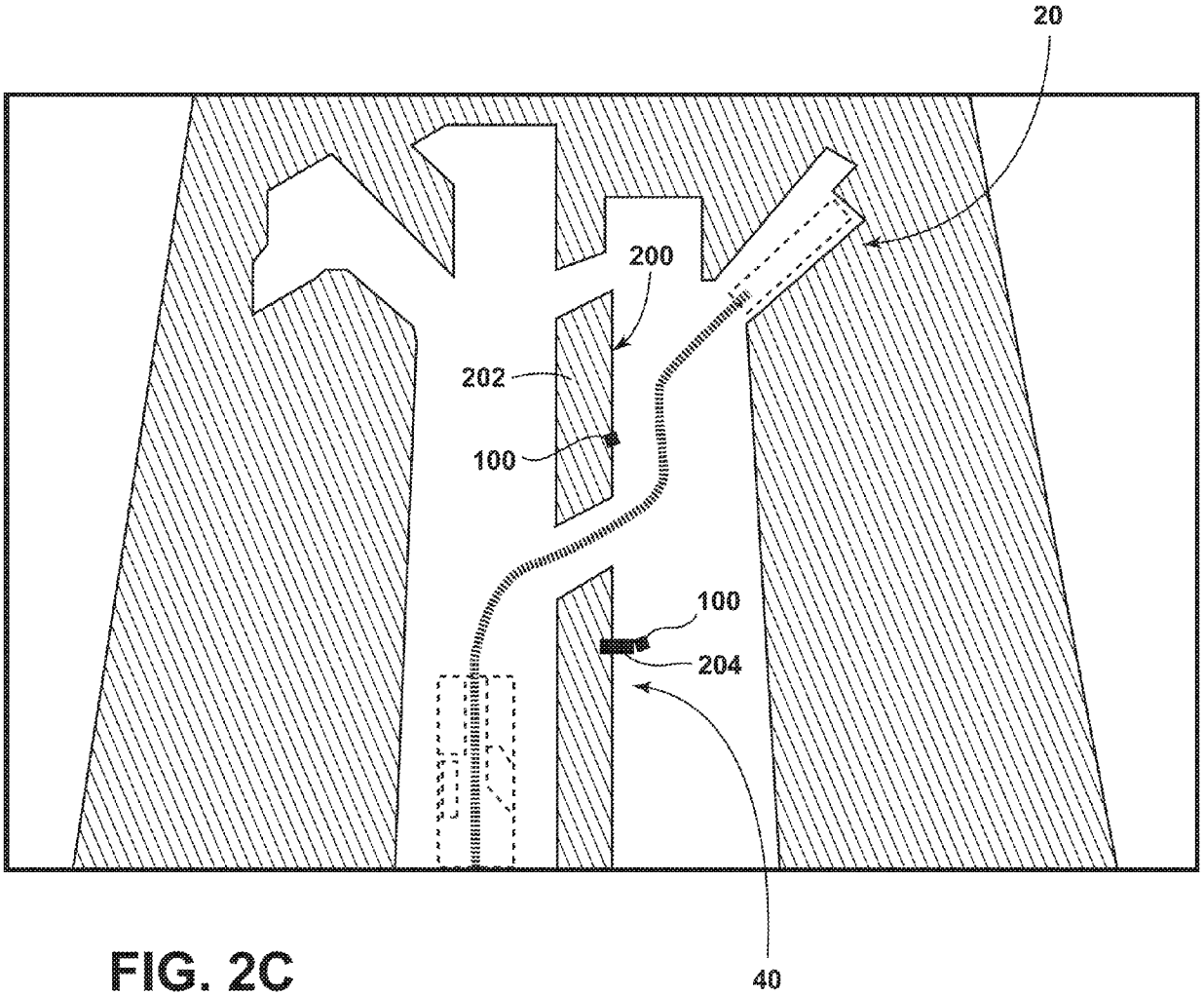

In yet other embodiments, the continuous miner 20 can be used to develop an industrial mineral roadway as illustrated in FIG. 2C. Again, in this situation, the continuous miner 20 operates in a direction generally toward the top of FIG. 2C and cut material is removed by haulage equipment 40 in an opposite direction.

Based on the roadway development configuration, the miner 20 can have different power and physical size parameters. These parameters can also vary based on the mineral being cut and the thickness of material layers or seams. For example, industrial mineral extraction typically involves wider and sometimes higher roadways due to the material being cut being inherently self-supporting (e.g., as compared to coal) and often being deposited in thicker layers or seams.

As noted above, to cut material, the continuous miner 20 is initially "sumped" into the cutting face. After "sumping," the ranging arm 28 is raised and/or lowered to shear and cut the cutting face. After completing a shear or a pass, the miner 20 is again "sumped" into the material. As also noted above, there can be a predetermined desired "sump depth," which can be related to the diameter of the drum 22, the hardness of the material being cut, and the energy or power available to the miner 20. "Sumping" too far (sometimes referred to as "over-webbing") puts excessive load on cutter motors and can create improper roof and/or floor profiles. Similarly, not "sumping" enough is inefficient in terms of production rate.

Therefore, it is useful to measure sump depth of the continuous miner 20. However, this measurement cannot easily be performed. For example, sump depth measurements cannot be made using encoders driven by movement of tracks (e.g., of the miner 20 and/or associated haulage equipment that moves with the miner 20) because the tracks can slip on the soft and often wet floor in the mine. Also, the dust and spray created during cutting makes it difficult to view a sump depth. Furthermore, as the miner 20 is typically remotely operated, an operator is not physically present where he or she can view a position of the miner 20 relative to a cutting face.

Accordingly, embodiments of the invention provide a sump depth management system (e.g., installed on the continuous miner 20) that uses radar ("Radio Detection And Ranging") to detect a sump depth of the continuous miner 20 and, optionally, automatically control the continuous miner 20 accordingly. Radar technology works on the basis of detecting the reflection of a radio wave, signal, or beam generated by a radar device from structures located around the radar device. A radar device can include a transmitter configured to generate a radio wave and a sensor configured to detect a radio wave. The time between transmitting the wave and detecting a reflection of the wave can be used to determine the distance between the radar device and the object reflecting the wave.

The sump depth management system includes at least one radar device and at least one controller. The controller is configured to receive timing information relating to radio wave transmissions and detections collected by the radar device and determine a distance between the radar device and a known object. This distance (i.e., changes to this distance over time) can be used to track the position of the continuous miner 20 (e.g., the sump depth of the continuous miner 20). For example, as described in more detail below, the controller can use distances between a radar device mounted on the continuous miner 20 and at least one stationary object located around the continuous miner 20 determine a sump depth of the miner 20. The stationary object can include a roadway wall or rib, stationary haulage equipment, roof bolts, and other devices.

Figure 3:
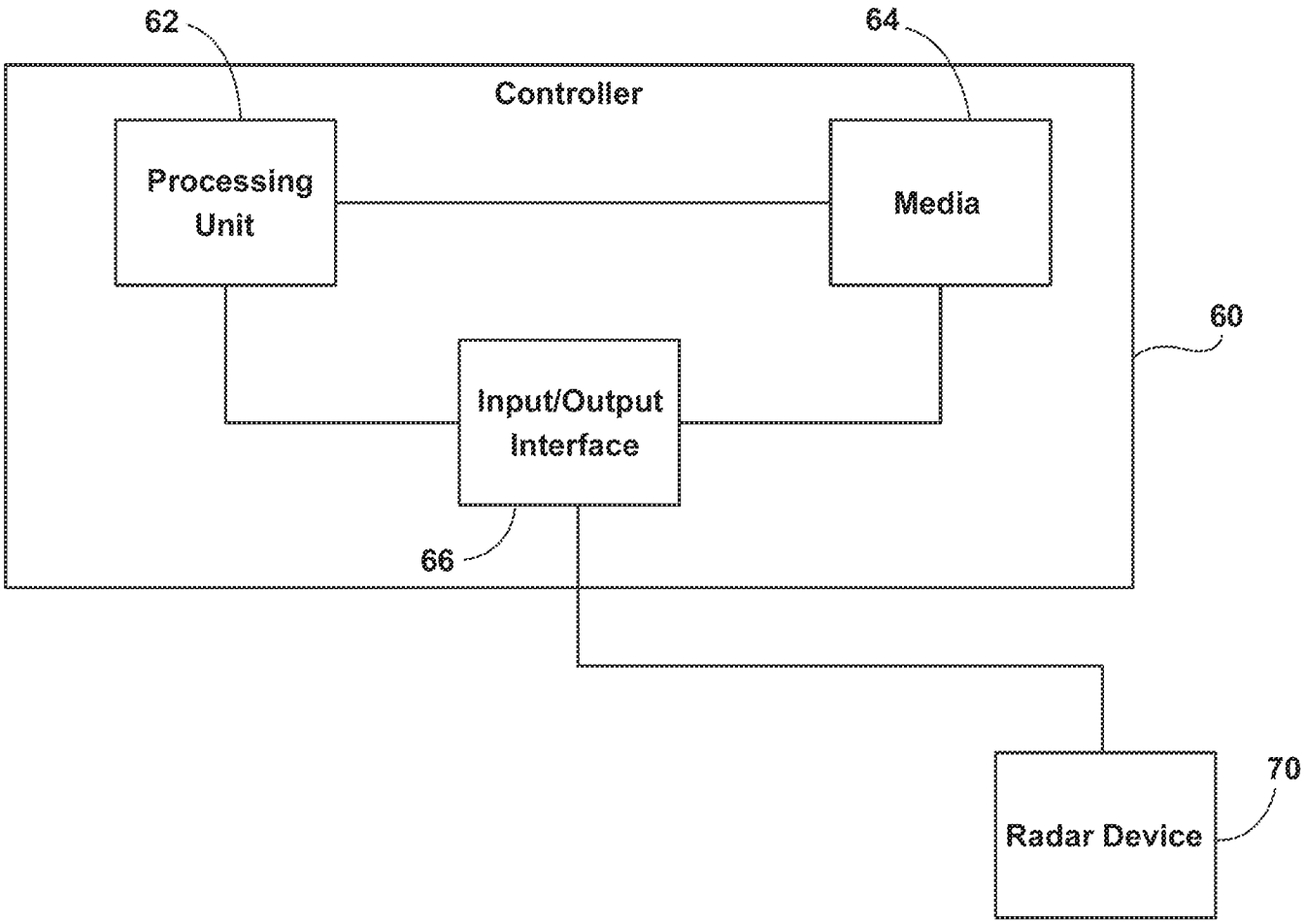
FIG. 3 schematically illustrates a controller configured to detect a sump depth of mining equipment.

FIG. 3 schematically illustrates a controller 60 configured to manage sump depth of the continuous miner 20. As illustrated in FIG. 3, the controller 60 includes a processing unit 62 (e.g., a microprocessor, application specific integrated circuit, etc.), non-transitory computer-readable media 64, and an input/output interface 66. The computer-readable media 64 can include random access memory ("RAM") and/or read-only memory ("ROM"). The input/output interface 66 transmits and receives information from devices external to the controller 60, such as a radar device 70 (e.g., over one or more wired and/or wireless connections). The controller 60 can also use the input/output interface 66 to communicate with other controllers, such as a controller for the continuous miner 20 that control movement (e.g., sumping and retracting) of the miner 20.

The processing unit 62 receives information (e.g., from the media 64 and/or the input/output interface 66) and processes the information by executing one or more instructions or modules. The instructions are stored in the computer-readable media 64. The processing unit 62 also stores information (e.g., information received through the input/output interface 66 and/or information generated by instructions or modules executed by the processing unit 62) to the media 64. It should be understood that although only a single processing unit, input/output interface, and computer-readable media module are illustrated in FIG. 3, the controller 60 can include multiple processing units, memory modules, and/or input/output interfaces.

The instructions stored in the computer-readable media 64 provide particular functionality when executed by the processing unit 62. In general, the instructions track a position of the continuous miner 20 over time using radar to determine a sump depth of the miner 20. Depending on the determined sump depth, one or more actions can be performed (e.g., by the controller 60 and/or a separate controller) to make the sump depth closer to a predetermined desired sump depth.

Figure 4:
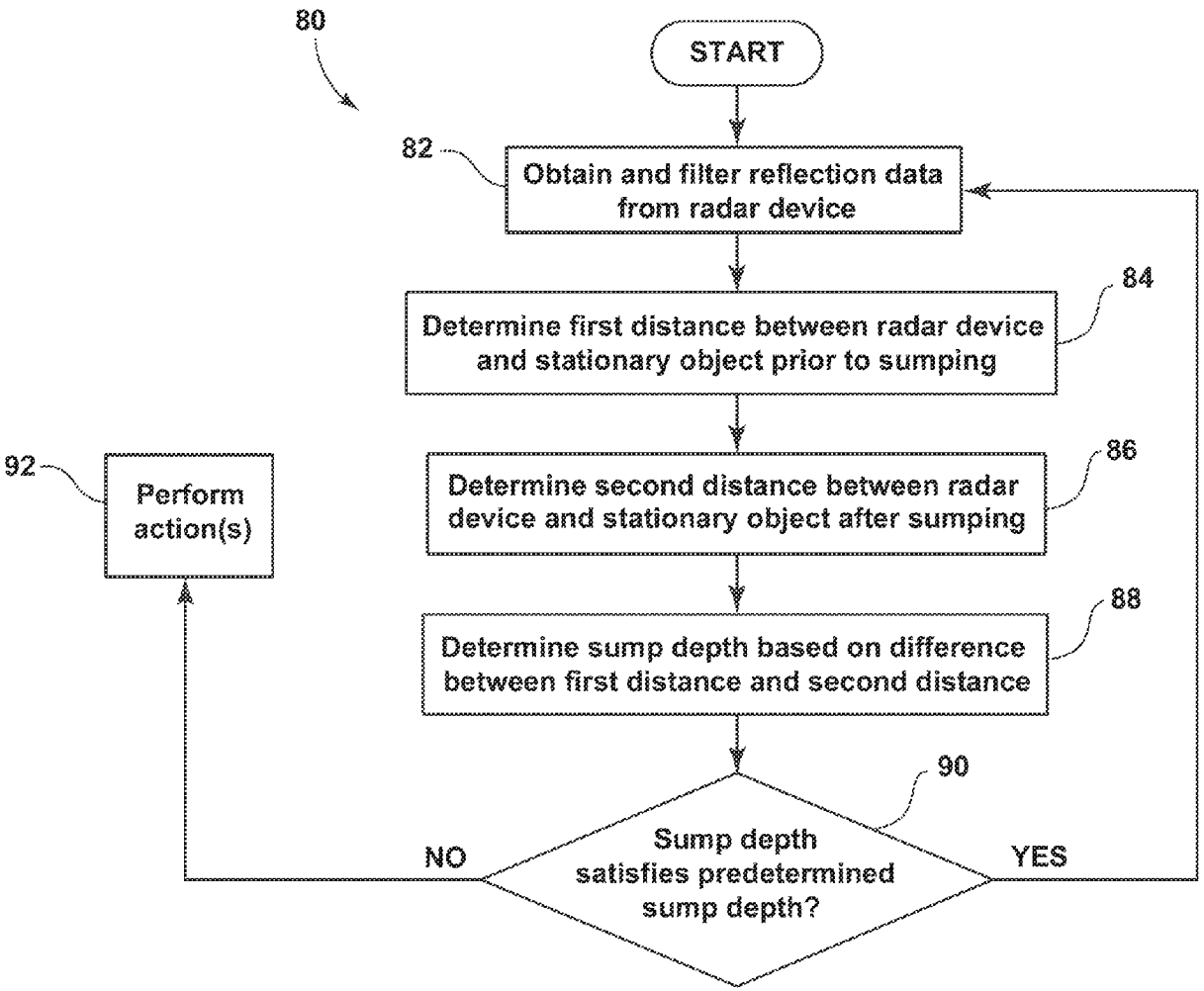
FIG. 4 is a flowchart illustrating a method performed by the controller of FIG. 3.

For example, the controller 60 can execute the instructions stored in the computer-readable media 64 to perform the method 80 illustrated in FIG. 4. The method 80 includes obtaining reflection data from at least one radar device 70 (at block 82). The reflection data can include timing information regarding radio waves transmitted by the radar device 70 and corresponding reflections detected by the radar device 70. It should be understood that in some embodiments in addition to obtaining data from the radar device 70, the controller 60 can be configured to provide data to the radar device 70. For example, the controller 60 can be configured to provide control signals to the radar device 70 (e.g., to turn the radar device 70 on and off, to modify operating parameters of the radar device 70, and/or to modify a physical position and/or orientation of the radar device 70).

Figure 5:
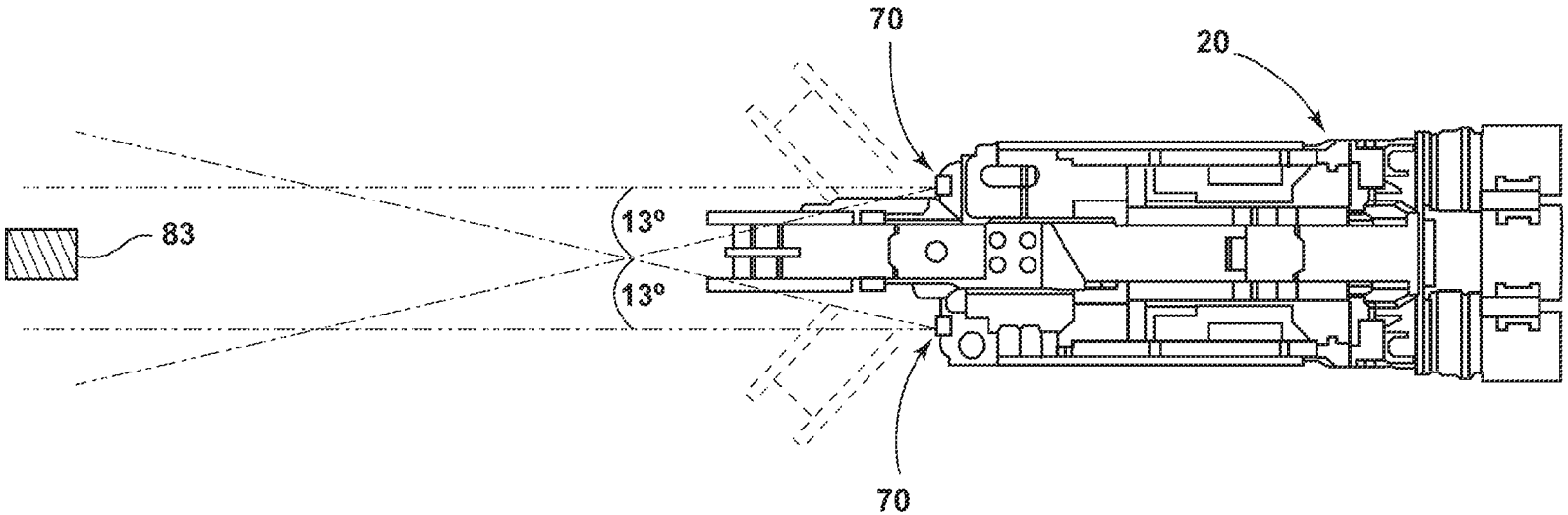
FIG. 5 schematically illustrates a continuous miner including two radar devices mounted on the continuous miner.
Figure 6B:
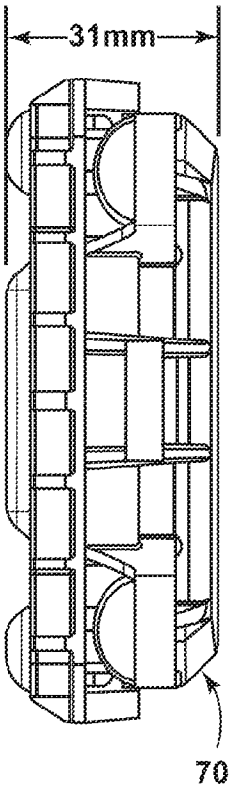
FIGS. 6A-B illustrate a radar device mountable on mining equipment according to one embodiment of the invention.
Figure 6A:
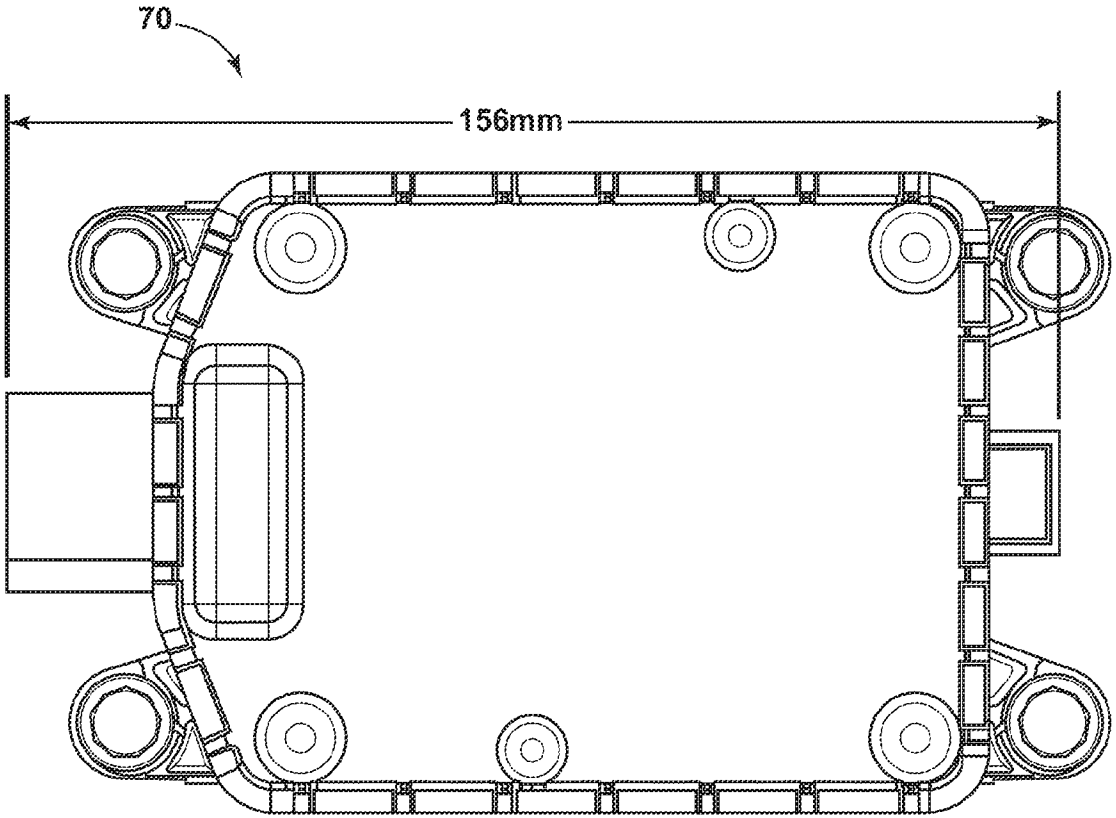

The radar device 70 can be configured to transmit radio waves to at least one stationary object located around the continuous miner 20. For example, as illustrated in FIG. 5, in some embodiments, two radar devices 70 are mounted to the rear of the miner 20 (i.e., the end opposite the end cutting the face). The radar devices 70 transmit radio waves (e.g., each within approximately a 13° range) toward the roof of the mine where one or more roof supports are located, such as an exposed thread of a roof or strata bolt 83. In some embodiments, the radar devices 70 are configured (e.g., mounted and angled) to transmit radio waves toward a roof bolt 83 located between approximately 20 meters and 150 meters behind the miner 20. FIGS. 6A-B illustrate dimensions of the radar device 70 according to one embodiment of the invention. It should be understood that in some embodiments, the radar device 70 and the controller 60 are formed as an integral device. In other embodiments, these components are separate devices.

Accordingly, using the configuration illustrated in FIG. 5, the reflection data provided by the radar devices 70 to the controller 60 includes timing information related to radio waves transmitted toward a roof bolt 83 and the reflections of such transmissions. The controller 60 uses the reflection data to determine a sump depth of the continuous miner 20. In particular, again using the example configuration illustrated in FIG. 5, the controller 60 uses the reflection data to determine a first distance between the radar devices 70 and the roof bolt 83 before the continuous miner 20 is sumped (at block 84) and a second distance between the radar devices 70 and the roof bolt 83 after the continuous miner 20 is sumped (i.e., after at least some sumping has occurred) (at block 86). Based on a difference between the first and second distances, the controller 60 determines a sump depth of the continuous miner 20 (at block 88).

In particular, as noted above, the time between transmitting a wave and detecting a reflection of the wave can be used to determine the distance between a radar device 70 and the object reflecting the wave and hence, a position of the object in terms of a distance from the radar device 70 (e.g., "X" millimeters from the radar device 70). Similarly, knowing the position of a radar device 70 relative to particular mining equipment (e.g., the miner 20), the controller 60 can use the determined distance between the radar device 70 and the detected object to determine a position of the object relative to the particular mining equipment (e.g., "X" millimeters from a continuous miner 20). When the object reflecting the waves is stationary, the controller 60 can use the changing distance between the object and a radar device 70 mounted on the continuous miner 20 to track the movement of the continuous miner 20 and, hence, determine the sump depth of the miner 20.

In some embodiments, the controller 60 (or a separate controller) uses the detected sump depth to determine whether any corrective actions need to be performed. For example, the controller 60 can be configured to compare the detected sump depth to a predetermined desired sump depth (including a single sump depth or a range of sump depths) (at block 90). If the detected sump depth fails to satisfy the predetermined sump depth (e.g., is not equal to or within a predetermined amount of the predetermined sump depth), the controller 60 can perform one or more automatic actions (at block 88). The automatic actions can include sumping the continuous miner 20 further into the cutting face (i.e., to increase the sump depth), retracting the continuous miner 20 from the cutting face (i.e., to decrease the sump depth), adjusting cutting performed by the drum 22 (e.g., stopping the drum 22), etc. The automatic actions can also include issuing one or more warnings (e.g., a visual warning, an audible warning, a tactile warning, or a combination thereof) that inform an operator of an improper sump depth. It should be understood that in some embodiments, the controller 60 can be configured to take different actions based on how much the sump depth of the continuous miner 20 varies from the predetermined sump depth. For example, the controller 60 can be configured to issue a warning if the detected sump depth varies from the desired sump depth by less than a predetermined amount and modify operation of the miner 20 when the detected sump depth varies from desired sump depth by more than the predetermined amount.

To perform an automatic action(s), the controller 60 can be configured to communicate with one or more controllers for the mining machine equipment (e.g., through the input/output interface 66 using a wired and/or wireless connection). For example, the controller 60 can be configured to send control signals to a speaker or display (on the continuous miner 20 or remote from the miner 20, such as on a remote control). Similarly, the controller 60 can be configured to send control signals to a controller of the continuous miner 20 that manages movement (e.g., sumping and retracting) of the miner 20. The control signals can instruct the controller how to move the miner 20. It should be understood, however, that in some embodiments, the controller 60 can be integrated into these other devices.

In some embodiments, the controller 60 can also be configured to provide feedback to an operator based on processed reflection data (e.g., regardless of whether the controller 60 performs any automatic actions). For example, the controller 60 can be configured to provide visual to an operator through a user interface. The user interface can display reflection data, distances between the radar devices 70 and the stationary object, and/or a current sump depth. Warnings issued by the controller 60 as described above can also be generated through the user interface. Also, in some embodiments, the user interface also displays filtering parameters applied by the controller 60 (described below) and can allow an operator to modify operational parameters applied by the controller 60 (e.g., change filtering parameters, initiate one or more automatic actions, change automatic action thresholds and/or ranges, etc.). Optionally, an operator can also use the user interface to override any automatic actions performed by the controller 60.

It should be understood that roof bolts 83 are only one example of a stationary object that can be used to track the movement of a continuous miner 20 during sumping. For example, a roadway wall or rib 200 (representing a side of a pillar 202 as illustrated in FIG. 2C) can be used as a stationary object. For example, a roadway wall will typically include "rough" coal and is often lined with mesh secured by steel bolts 204 (see FIG. 2C). A roadway wall can be located between approximately 0 meters and 10 meters from the frame 24 but typically is located between 0.5 meters and 1.0 meter from the frame 24. Accordingly, radar device(s) 70 mounted on the miner 20 can be directed toward a particular section of a roadway wall or rib 200 (e.g., a bolt 204 used to secure mesh to the wall).

Also, haulage equipment can also be used as a stationary object for tracking movement of the miner 20. Also, a stationary object can be deliberately affixed in the mining environment and used as a point of reference for tracking sump depth. It should also be understood that more than one stationary object can be used to detect a sump depth of the continuous miner 20 (e.g., multiple roof bolts 83, a roof bolt and a rib, etc.). Also, it should be understood that a "stationary object," as that term is used in the present application can include an object that moves a known (e.g., known a priori and/or measured) speed and/or direction. In particular, the known movement of such a device can be compensated for by the controller 60 when determining a change in distance between the radar device 70 and the object.

Figure 7:
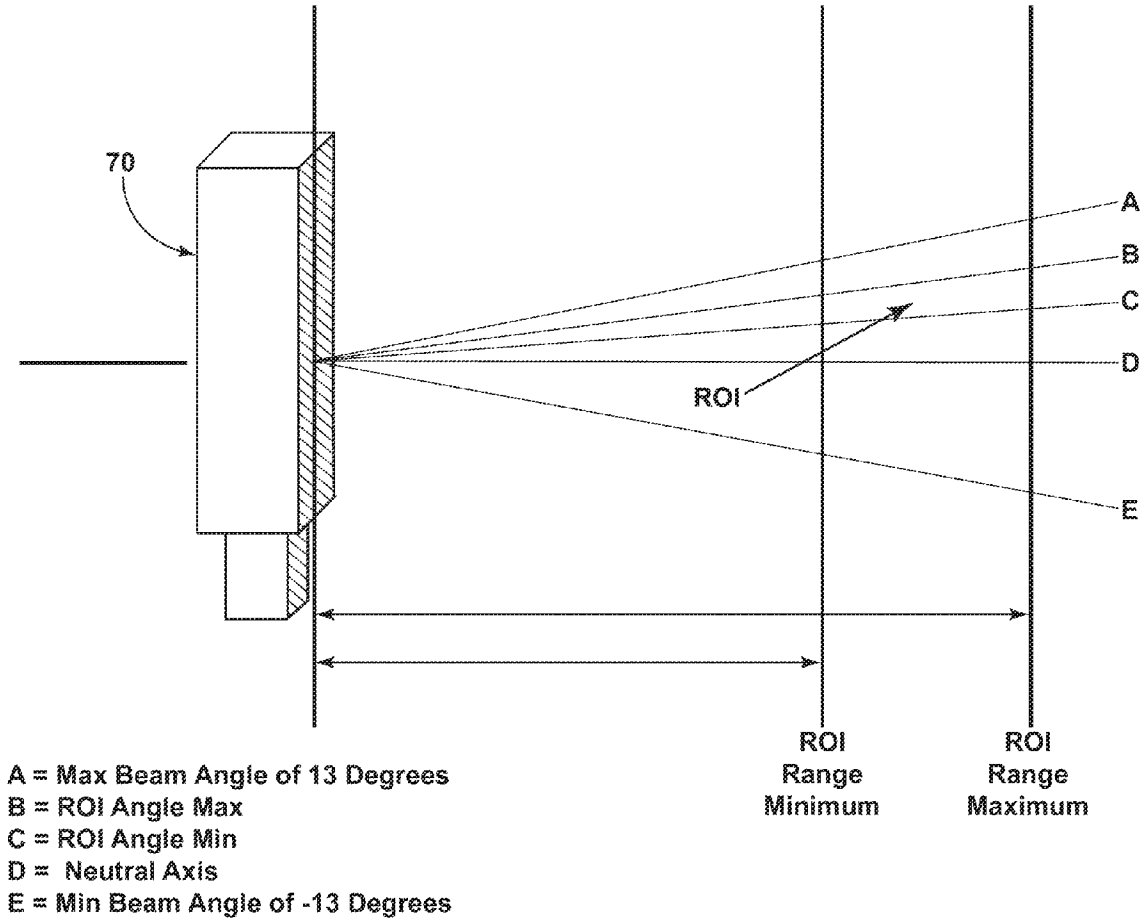
FIG. 7 graphically illustrates a region-of-interest filter applied by the controller of FIG. 3.

In some embodiments, the radio wave generated by the radar device(s) 70 reflects from many different materials, including steel, coal, and individuals. Also, the range of the radio wave can be approximately 200 meters. However, this range may be greater than needed to track movement of the continuous miner 20. For example, in some embodiments, only roof bolts within a particular distance to the rear of the miner 20 are used to track a position of a continuous miner. Accordingly, the controller 60 can be configured to filter the reflection data to identify those reflections associated with a region of interest ("ROI"). For example, as illustrated in FIG. 7, a radar device 70 can be configured to detect a radio wave or beam having a maximum possible angle and a minimum possible angle (e.g., approximately 13° and approximately −13°, respectively) (see A and E in FIG. 7) from a neutral or horizontal axis (see D in FIG. 7). Within this range of possible angles, a maximum ROI angle and a minimum ROI angle can be defined (see B and C in FIG. 7). Accordingly, only reflections detected between the maximum ROI angle and the minimum ROI angle may be processed by the controller 60 to determine a sump depth of the continuous miner 20. The ROI angles can be configured for different applications (e.g., different positions of the controller 60 and/or the radar device(s) 70, different types of equipment, different equipment configurations, different mine conditions, etc.), which allows the controller 60 to accurately track a position of the continuous miner 20.

In addition and/or alternatively, the controller 60 can be configured to apply a signal strength filter to the reflection data to identify reflections from different surfaces or materials (e.g., metallic surfaces versus non-metallic surfaces). For example, the controller 60 can be configured to identify whether a detected reflection has a signal strength satisfying a predetermined threshold or range (e.g., approximately 70 dB associated with reflections from metallic surfaces). In some embodiments, the controller 60 can use multiple thresholds or ranges of signal strengths to identify reflections originating from a plurality of different surfaces (e.g., reflections from individuals, steel or other metallic surfaces, etc.).

It should be understood that the filtering and processing of the reflection data as described in the present application can be distributed in various configurations between a radar device 70 and the controller 60. For example, in some embodiments, a radar device 70 provides raw timing data to the controller 60, and the controller 60 performs the filtering and the processing. In other embodiments, a radar device 70 is configured to perform at least some of the filtering and processing described above prior to providing data to the controller 60.

Figure 8:
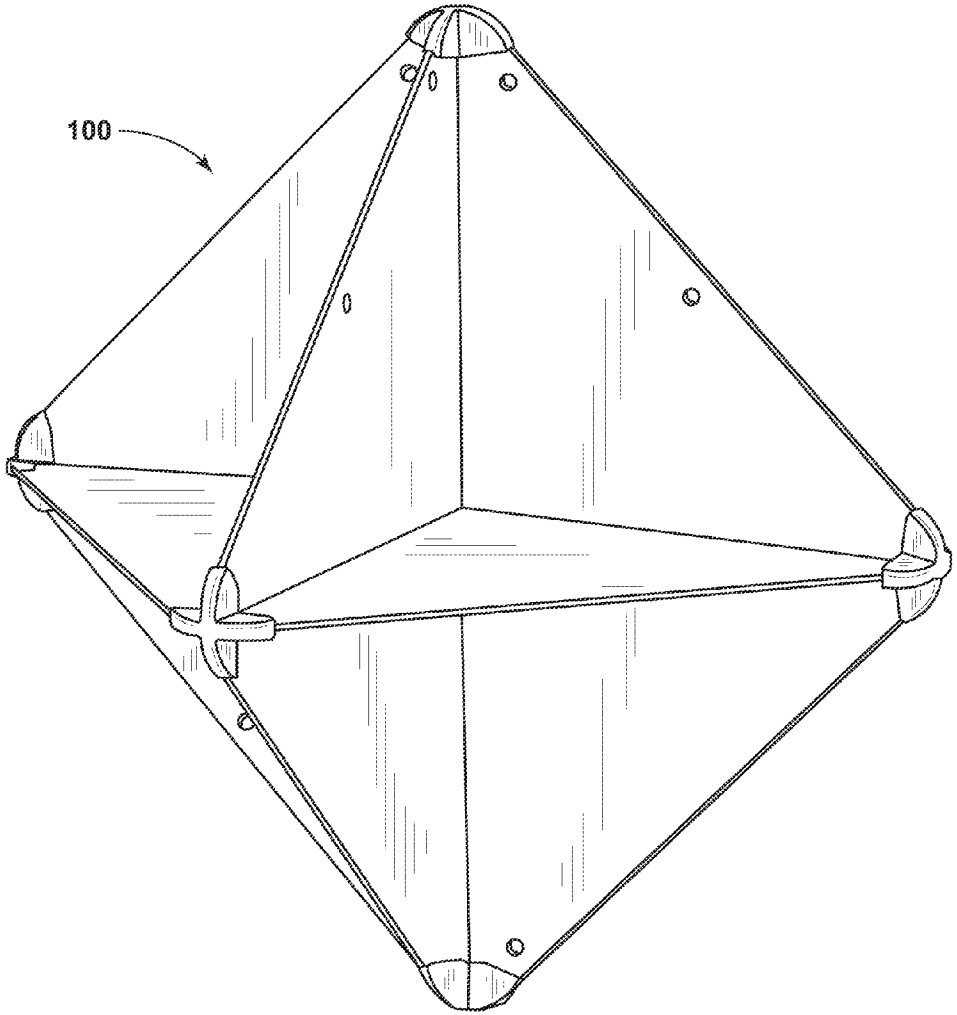
FIG. 8 illustrates an anti-stealth device.
Figure 9:
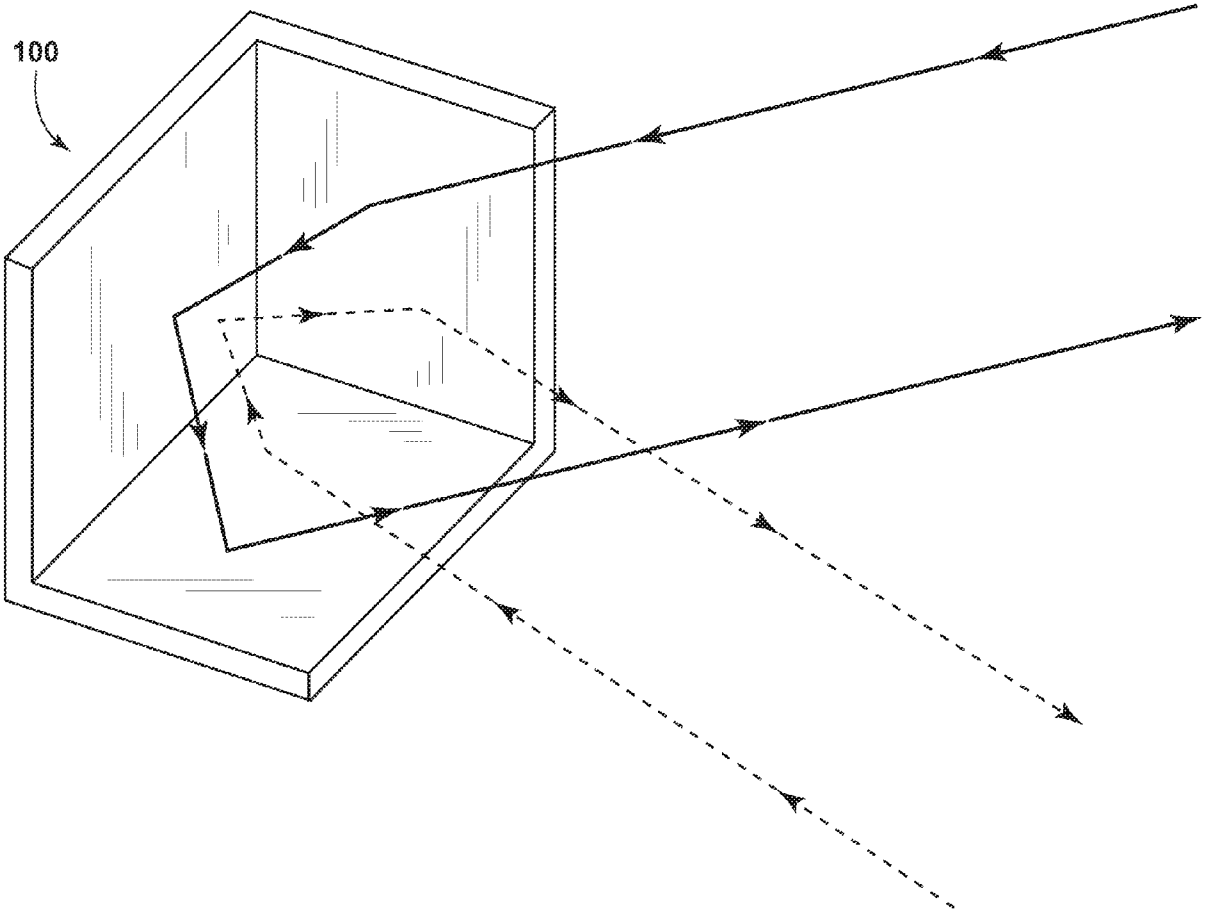
FIG. 9 schematically illustrates a corner cube reflector.

In some embodiments, although reflections from metallic surfaces are detectable, the effectiveness of radar in any application can be increased if an anti-stealth device is positioned within a ROI that reflects a radio wave back to the radar device 70 in a predictable and efficient manner. For example, in one embodiment, a corner cube reflector 100 (see, e.g., FIG. 8) can be deployed as a target for radio waves generated by the radar device(s) 70. As illustrated in FIG. 9, an incident beam striking a corner cube reflector 100 goes through a series of internal reflections and leaves the reflector 100 in the opposite direction from which it came (i.e., back toward the radar device 70 that originally generated the beam). Accordingly, corner cube reflectors 100 are often referred to as "boomerang reflectors." Incorporating a corner cube reflector 100 into a stationary object used as a point of reference for detecting sump depth increases the accuracy of the radar device 70 and the associated sump depth management performed by the controller 60.

In some embodiments, corner cube reflectors 100 can be attached to or incorporated into (i.e., manufactured as part of the structure of) the stationary object (see FIG. 2C). For example, the corner cube reflector 100 can be added to a stationary object as an after-market addition. In other embodiments, the corner cube reflector 50 can be created as part of the fabrication of the stationary object to provide robustness for mining environments. It should be understood that although corner cube reflectors 100 are described and illustrated in the present application, other types of anti-stealth devices can be used to improve radar detection accuracy.

It should be understood that the functionality performed by the controller 60 as described in the present application can be distributed among multiple controllers and/or devices (including, for example, the radar device(s) 70). As noted above, it should also be understood that the controller 60 and one or more radar device 70 can be combined as an integrated device or can be provided as separate devices on the same or different pieces of equipment. For example, in one embodiment, the controller 60 and the radar device(s) 70 are part of the continuous miner 20. In other embodiments, the radar device(s) 70 are included on the miner 20 and the controller 60 is included on a separate device (e.g., a remote control for the miner 20). In still other embodiments, the radar device(s) 70 are installed on a stationary object and transmit radio waves toward the continuous miner 20 to track a position of the continuous miner 20. In these situations, the continuous miner 20 can include an anti-stealth device as described above to provide accurate radar detection.

Thus, embodiments of the invention provide methods and systems for using radar to detect a distance between mining equipment, such as a continuous miner and a stationary point of reference (e.g., a support bolt). The change in this detected distance over a period of time is used to determine movement of the mining equipment, such as a sump depth of a continuous miner. The determined movement of the mining equipment can be processed to determine whether any actions (e.g., automatic actions) should be performed to adjust movement of the mining equipment. The systems and methods can use reflections from anti-stealth devices incorporated into objects positions around a radar device to increase the accuracy of detecting distances between the mining equipment and the stationary point of reference.

Various features and advantages of the invention are set forth in the following claims.

What is claimed is:

1. A system for operating a mining machine, the system comprising:

at least one controller configured to obtain first reflection data from at least one radar device, determine, based on the first reflection data, a first distance between a point of reference and a stationary object before sumping the mining machine into material, obtain second reflection data from the at least one radar device, determine, based on the second reflection data, a second distance between a point of reference and the stationary object after sumping the mining machine into the material, determine a sump depth of the mining machine based on the first distance and the second distance, and perform at least one automatic action when the determined sump depth does not satisfy at least one predetermined sump depth.

2. The system of claim 1, wherein the stationary object includes an anti-stealth device.

3. The system of claim 2, wherein the anti-stealth device includes a corner cube reflector.

4. The system of claim 1, wherein the stationary object includes a bolt.

5. The system of claim 1, wherein the stationary object includes a bolt positioned between 6 meters and 1 meters to a rear of the mining machine.

6. The system of claim 1, wherein the stationary object includes a roadway rib.

7. The system of claim 1, wherein the stationary object includes haulage equipment.

8. The system of claim 1, wherein the at least one controller is further configured to filter the reflection data to identify at least one reflection received by the at least one radar device having an angle within a predetermined range of angles.

9. The system of claim 1, wherein the at least one controller is further configured to filter the reflection data to identify at least one reflection received by the at least one radar device having a signal strength greater than a predetermined threshold.

10. The system of claim 1, wherein the mining machine includes a continuous miner and the at least one radar device includes two radar devices mounted to a rear of the continuous miner.

11. The system of claim 1, wherein the at least one automatic action includes issuing a warning to an operator.

12. The system of claim 1, wherein the at least one automatic action includes sumping the mining machine further into the material.

13. The system of claim 1, wherein the at least one automatic action includes retracting the mining machine from the material.

14. The system of claim 1, wherein the at least one automatic action includes stopping a cutting drum of the mining machine.

15. A method of operating a continuous miner comprising:

determining a first distance to a stationary object based on data from at least one radar device;

after sumping the continuous miner into material being mined, determining a second distance to the stationary object based on data from the at least one radar device;

determining, with at least one controller, a sump depth of the continuous miner based on the first distance and the second distance; and when the determined sump depth does not satisfy a predetermined sump depth, modifying operation of the continuous miner.

16. The method of claim 15, wherein determining the first distance to the stationary object includes determining a distance to a bolt.

17. The method of claim 15, wherein determining the first distance to the stationary object includes determining a distance to a roadway rib.

18. The method of claim 15, wherein modifying the operation of the continuous miner includes automatically sumping the continuous miner further into the material.

19. The method of claim 15, wherein modifying the operation of the continuous miner includes automatically retracting the continuous miner from the material.

20. The method of claim 15, wherein modifying the operation of the continuous miner includes automatically stopping a cutting drum of the continuous miner.

* * * * *